US007520378B2

(12) United States Patent
Hansen et al.

(10) Patent No.: US 7,520,378 B2
(45) Date of Patent: Apr. 21, 2009

(54) CHAIN DRIVEN CONVEYOR HAVING AUTOMATIC TENSIONING STREET SWEEPING METHOD AND SYSTEM

(75) Inventors: Karl Robert Hansen, Cottage Grove, MN (US); Craig Daniel Block, St. Louis Park, MN (US)

(73) Assignee: Tennant Company, Minneapolis, MN (US)

( * ) Notice: Subject to any disclaimer, the term of this patent is extended or adjusted under 35 U.S.C. 154(b) by 755 days.

(21) Appl. No.: 10/849,512

(22) Filed: May 17, 2004

(65) Prior Publication Data

US 2004/0226122 A1 Nov. 18, 2004

Related U.S. Application Data

(60) Provisional application No. 60/470,586, filed on May 15, 2003.

(51) Int. Cl.
*B65G 39/16* (2006.01)

(52) U.S. Cl. ..... 198/807; 198/716; 198/806; 198/810.04; 198/813

(58) Field of Classification Search ..... 198/716, 198/727, 731, 733, 806, 807, 809, 810.04, 198/813
See application file for complete search history.

(56) References Cited

U.S. PATENT DOCUMENTS 2,788,883 A * 4/1957 Schwenk ..... 198/813
4,421,228 A * 12/1983 Marsiglio et al. ..... 198/814
4,799,584 A * 1/1989 Hartsuiker et al. ..... 198/709
4,884,313 A * 12/1989 Zoni ..... 15/340.3
5,143,203 A * 9/1992 Hinner ..... 198/708
5,156,261 A * 10/1992 Dorner ..... 198/816
5,174,435 A * 12/1992 Dorner et al. ..... 198/806
5,467,171 A * 11/1995 Castelli et al. ..... 399/162
5,511,650 A * 4/1996 Hurworth ..... 198/813
5,659,851 A * 8/1997 Moe et al. ..... 399/165
5,896,979 A * 4/1999 Hokari et al. ..... 198/807
5,899,321 A * 5/1999 El-Ibiary ..... 198/807
6,142,290 A * 11/2000 Tagliaferri ..... 198/716
6,279,733 B2 * 8/2001 Eltvedt ..... 198/816
6,336,550 B1 * 1/2002 Muntener ..... 198/806
6,431,348 B2 * 8/2002 Malmberg ..... 198/806
6,695,130 B1 * 2/2004 Blaylock et al. ..... 198/813
6,712,200 B2 * 3/2004 Ubaldi ..... 198/810.03
6,776,280 B2 * 8/2004 Hovstø et al.
6,802,414 B2 * 10/2004 Buhne ..... 198/813
7,086,118 B2 * 8/2006 Engel et al. ..... 15/340.4

* cited by examiner

*Primary Examiner*—Douglas A Hess
(74) *Attorney, Agent, or Firm*—Altera Law Group, LLC

(57) ABSTRACT

Disclosed herein is a street sweeper having a vertical chain driven conveyor apparatus. The vertical chain driven conveyor apparatus is provided with a jointed shaft to compensate for chain wear over the life of the chains. The vertical chain driven conveyor apparatus is provided with an automatically adjusting chain tension adjustment system. The vertical chain driven conveyor apparatus is provided with locking adjustment mechanism to prevent the chains from losing tension when the sweeper is turned off. An initialization program is operable to restore chain tension when the street sweeper is started and prevent sweeping operations until a desired chain tension has been indicated.

17 Claims, 7 Drawing Sheets

CHAIN DRIVEN CONVEYOR HAVING AUTOMATIC TENSIONING STREET SWEEPING METHOD AND SYSTEM

CROSS-REFERENCE TO RELATED APPLICATIONS

This is a Non-Provisional (Utility) patent application of provisional application Ser. No. 60/470586 filed May 15, 2003.

BACKGROUND OF THE INVENTION

1. Field of the Invention.

The present invention relates to a street sweeper having a vertical chain driven conveyor apparatus. The vertical chain driven conveyor apparatus may be provided with an automatic chain adjustment system. The vertical chain driven conveyor apparatus also may be provided with a locking adjustment mechanism to prevent the chains losing tension when the sweeper is turned off. The sweeper may also be provided with an initialization program to restore tension in the chains upon startup and prevent sweeping operations until a desired chain tension has been indicated.

2. Description of Related Art.

Street sweepers are a common necessity to maintaining the safety and beauty of streets and highways throughout the world. Street sweepers come in a variety of shapes and sizes for a variety of different functions. Some surfaces must be maintained meticulously clean for safety purposes, such as airport runways, taxiways, and helicopter landing strips. Other surfaces require cleaning to prevent flooding, such as sweeping the leaves from highways and streets to prevent ditches, culverts and storm drains from becoming clogged and preventing the runoff of snow melt and storm water.

In small towns and suburban neighborhoods, small, quiet, dust-less, and pollution free street sweepers are demanded. In order to make a smaller street sweeper, a vertical chain driven conveyor apparatus may be applied to reduce the overall length of the street sweeper. Vertical chain driven conveyors suffer a drawback that horizontal chain conveyors are not as hampered by. When the chains stretch and become loose in a horizontal chain driven conveyor, the middle portion of the chain merely sags, but the chain does not become dislodged from the sprockets holding the chain at either end of the conveyor.

However, in a vertical chain driven conveyor system, tension must be maintained in the chains at all times, otherwise the chain will fall off the bottom sprocket leading to perhaps catastrophic damage to the conveyor system. Additionally, if the chains are not held in tension, the operation of the conveyor will be impeded or ultimately fail.

As the chains of the conveyor elongate due to wear, the tension force decreases without adjustment. To maintain proper adjustment, the chains must be routinely readjusted. Chain adjustment is laborious, time consuming, and to the unskilled, dangerous. Not only will a street sweeper operator need to check the chain tension before beginning sweeping operations, it may be necessary to adjust the chain tension at least a few millimeters every few hours, depending upon the rigors of the sweeping operation.

It can be seen that there is a need for a street sweeper having a vertical chain driven conveyor apparatus that automatically adjusts the chain tension and prevents damage to the street sweeper and saves the operator time. The present invention fulfills these and other needs, and addresses other deficiencies of prior art implementations.

SUMMARY OF THE INVENTION

To overcome the limitations in the prior art described above, and to overcome other limitations that will become apparent upon reading and understanding the present specification, the present invention discloses a street sweeper having a vertical chain driven conveyor apparatus. The vertical chain driven conveyor apparatus may be provided with a multiple jointed shaft to compensate for uneven chain wear over the life of the chains.

The street sweeper may also be provided with a manual mechanical adjustment mechanism to ensure that the chains remain tensioned. The vertical chain driven conveyor apparatus may be provided with an automatically adjusting hydraulic or pneumatic adjustment system. The vertical chain driven conveyor apparatus may be provided with a ratchet pawl and pin adjustment mechanism to prevent the chains falling out of tension when the street sweeper is turned off. The conveyor apparatus may also be provided with check valves to prevent the chains loosing tension when the sweeper is turned off or may be provided with a closed system having an accumulator to perform the identical function.

An apparatus in accordance with the principles of the present invention may include a street sweeper including a roller brush for directing debris into an intermediate hopper. The sweeper may also include a vertical chain driven conveyor apparatus. The conveyor including an upper driving shaft, a lower shaft, and at least a pair of chains operatively connecting the shafts. The conveyor may also include independent automatically adjusting chain tensioning mechanisms for maintaining tension in each of the chains. The conveyor may also include a plurality of flights. Each flight may be associated with each of the chains and the vertical chain driven conveyor elevates debris via the flights from the intermediate hopper to a main hopper.

Other embodiments of a system in accordance with the principles of the invention may include alternative or optional additional aspects. One such additional aspect of the present invention is that the chain adjusting mechanisms may include a hydraulic cylinder having an extendible shaft for providing and maintaining tension in the chains.

Another aspect of the present invention is that the chain adjusting mechanisms may include a pneumatic cylinder having an extendible shaft for providing and maintaining tension in the chains.

Another aspect of the present invention is that the upper driving shaft may include at least one rotatable multi-directional joint and portions of the shaft may be oriented along different axes of rotation.

Another aspect of the present invention is that the at least one rotatable multi-directional joint may also include two rotatable multi-directional joints and ends of the shaft may be oriented along a horizontal axis and a central extent of the shaft between the joints may be oriented at an angle with respect to the horizontal axis.

Another aspect of the present invention is that the street sweeper may also include a locking adjustment mechanism for maintaining tension in the chains when the street sweeper is turned off.

Another apparatus in accordance with the principles of the present invention may include a street sweeper including a roller brush for directing debris to an intermediate hopper. The street sweeper may also include a vertical chain driven conveyor apparatus. The conveyor may include an upper driving shaft. The upper shaft including a pair of rotatable multi-directional joints. The ends of the shaft rotate about a horizontal axis while a central extent of the shaft rotates about an axis oriented at an angle with respect to the horizontal axis. The conveyor may also include a lower shaft and at least a pair of chains operatively connecting the shafts. The conveyor may also include a plurality of flights. Each flight may be associated with each of the chains and the vertical chain driven conveyor elevates debris from the intermediate hopper to a main hopper.

Another aspect of the present invention is that the street sweeper may also include independent automatically adjusting chain tensioning mechanisms for maintaining tension in each of the chains.

Another aspect of the present invention is that the chain adjusting mechanisms may include a hydraulic cylinder having an extendible shaft for providing and maintaining tension in the chains.

Another aspect of the present invention is that the chain adjusting mechanisms may include a pneumatic cylinder having an extendible shaft for providing and maintaining tension in the chains.

Another aspect of the present invention is that the street sweeper may also include a locking adjustment mechanism for maintaining tension in the chains when the street sweeper is turned off.

Another apparatus in accordance with the principles of the present invention may also include a street sweeper including a roller brush for directing debris to an intermediate hopper. The street sweeper may also include a vertical chain driven conveyor apparatus. The conveyor may include an upper driving shaft, a lower shaft and at least a pair of chains operatively connecting the shafts. The conveyor may also include a locking adjustment mechanism for maintaining tension in the chains when the street sweeper is turned off. The conveyor may also include a plurality of flights. Each flight may be associated with each of the chains and the vertical chain driven conveyor elevates debris via the flights from the intermediate hopper to a main hopper.

Another aspect of the present invention is that the locking adjustment mechanism may be a tensioned ratchet pawl and pin engagement.

Another aspect of the present invention is that the street sweeper may also include a chain adjusting mechanism including a hydraulic cylinder having an extendible shaft for providing and maintaining tension in the chains.

Another aspect of the present invention is that the locking adjustment mechanism may be provided with a check valve associated with the hydraulic cylinder or an accumulator associated with a fully enclosed pressurized system.

Another aspect of the present invention is that the street sweeper may also include a chain adjusting mechanism including a pneumatic cylinder having an extendible shaft for providing and maintaining tension in the chains.

Another aspect of the present invention is that the locking adjustment mechanism may be provided with a check valve associated with the pneumatic cylinder or an accumulator associated with a fully enclosed pressurized system.

Another apparatus in accordance with the principles of the present invention may also include a street sweeper including means for elevating debris from an initial debris collecting area to a final debris collecting area. The street sweeper may also include means for automatically maintaining tension in a chain associated with the means for elevating debris. The street sweeper may also include means for locking the means for automatically maintaining tension in a chain when the street sweeper is turned off.

Another aspect of the present invention is that the means for elevating debris may be a vertical chain driven conveyor apparatus.

Another aspect of the present invention is that the means for automatically maintaining tension may be a hydraulic cylinder associated with a vertical chain driven conveyor apparatus.

Another aspect of the present invention is that the means for locking the means for automatically maintaining tension may be a check valve associated with the hydraulic cylinder or an accumulator associated with a fully enclosed pressurized system.

Another aspect of the present invention is that the means for automatically maintaining tension may be a pneumatic cylinder associated with a vertical chain driven conveyor apparatus.

Another aspect of the present invention is that the means for locking the means for automatically maintaining tension may be a check valve associated with the pneumatic cylinder or an accumulator associated with a fully enclosed pressurized system.

Another aspect of the present invention is that the means for locking the means for automatically maintaining tension may be a tensioned ratchet pawl and pin engagement.

Another apparatus in accordance with the principles of the present invention may also include a vertical conveyor apparatus including an upper driving shaft, a lower shaft, and at least a pair of chains. The conveyor may also include independent automatically adjusting chain tensioning mechanisms for maintaining tension in each of the chains. The conveyor may also include a plurality of flights. Each flight may be associated with each of the chains.

Another aspect of the present invention is that the chain adjusting mechanisms may include a hydraulic cylinder having an extendible shaft for providing and maintaining tension in the chains.

Another aspect of the present invention is that the chain adjusting mechanisms may include a pneumatic cylinder having an extendible shaft for providing and maintaining tension in the chains.

Another aspect of the present invention is that the upper driving shaft may include at least one rotatable multi-directional joint and portions of the shaft are oriented along different axes of rotation.

Another aspect of the present invention is that the at least one rotatable multi-directional joint further may include two rotatable multi-directional joints and ends of the shaft are oriented along a horizontal axis and a central extent of the shaft may be oriented at an angle with respect to the horizontal axis.

Another aspect of the present invention is that the conveyor apparatus may also include a locking adjustment mechanism for maintaining tension in the chains.

Another apparatus in accordance with the principles of the present invention may also include a method of removing debris from a street including directing debris into an initial hopper, and elevating the debris from the initial hopper to a final hopper. The method may also include maintaining tension in a plurality of chains with a shaft having rotatable multi-directional joints disposed proximate ends of the shaft. The method may also include automatically maintaining tension in the plurality of chains independently with a hydraulic tensioning mechanism associated with each chain. The method may also include maintaining tension in the plurality of chains independently with a locking adjustment mechanism that prevents slack developing in the chains.

Another method in accordance with the principles of the present invention may also include initializing street sweeping operations by initiating an initialization program to restore tension in a plurality of chains associated with a vertical conveyor apparatus in a street sweeper. The initialization program performing at least the following, energizing an automatic chain tensioning apparatus, applying a tensioning force to ends of a drive shaft associated with the chains, and indicating when a desired chain tension has been achieved. The program also prevents sweeping operations from occurring until the desired chain tension has been indicated. The initialization program automatically initiates when the street sweeper is turned on and delays sweeping operations for several seconds while chain tension is analyzed and determined.

The foregoing objects, advantages and distinctions of the invention, among others, are obtained in a presently preferred construction that provides a street sweeper having a vertical chain driven conveyor apparatus having automatic chain tensioning means, a drive shaft having rotatable multi-directional joints and a locking mechanism to maintain chain tension when the street sweeper is turned off. The foregoing features may be inventions alone or in combination.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

Figure 1:
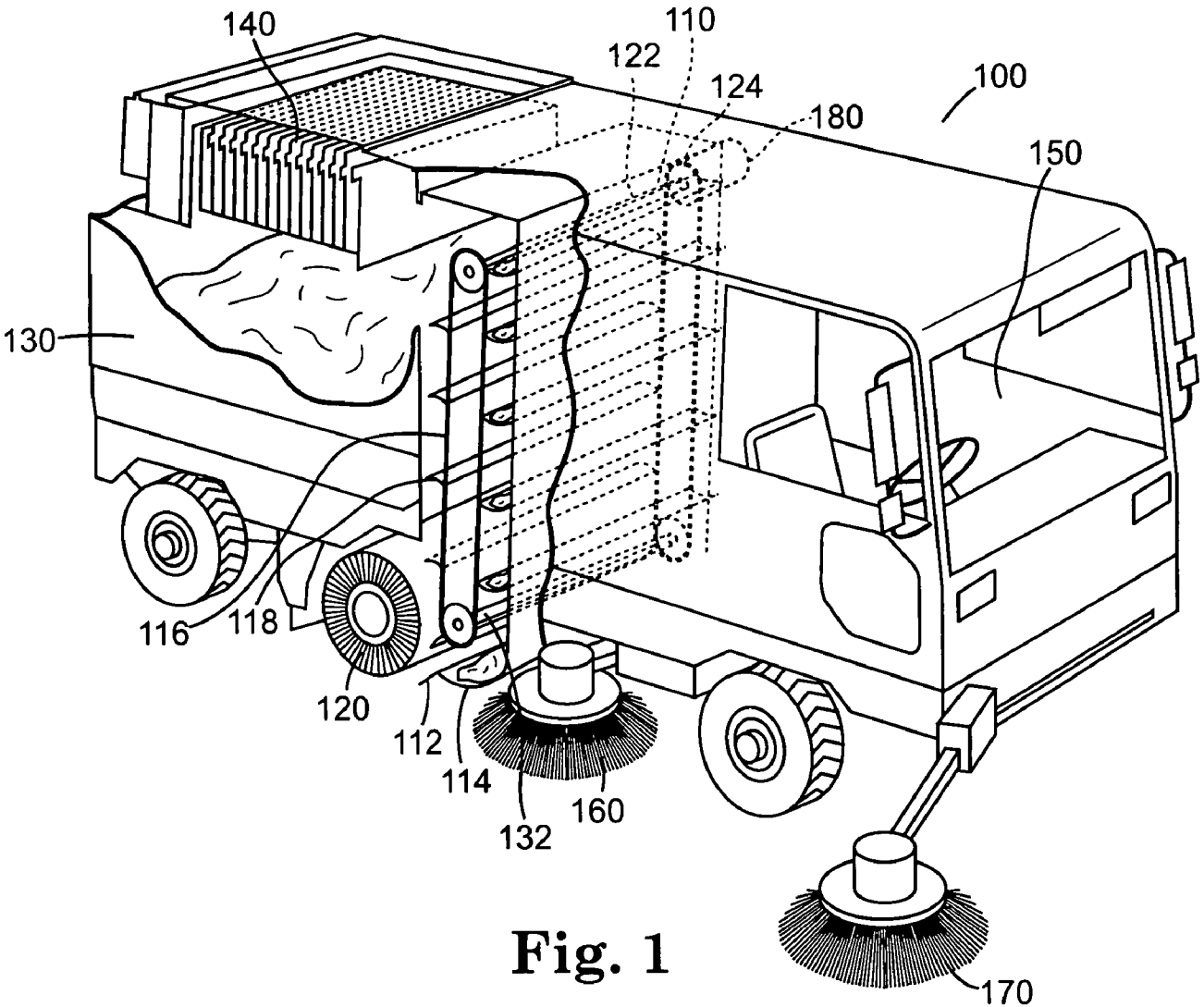
FIG. 1 illustrates a street sweeper having a vertical chain driven conveyor apparatus according to an embodiment of the present invention.

While the invention is amenable to various modifications and alternative forms, specifics thereof have been shown by way of example in the drawings and will be described in detail herein. It is to be understood, however, that the intention is not limited to the invention shown in the particular embodiments described. On the contrary, the invention is intended to cover all modifications, equivalents, and alternatives falling within the scope of the invention as defined by the claims appended hereto.

DETAILED DESCRIPTION OF THE INVENTION

In the following description of the illustrated embodiments, reference is made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

The present invention provides a street sweeper having a vertical chain driven conveyor apparatus. The term "chain" needs to be interpreted broadly in this application, since it does not refer only to link chains, but can include belts and any other drive means or drive bands, which is subject to wear and stretching. The vertical chain driven conveyor apparatus may be provided with a multiple jointed shaft to compensate for chain wear over the life of the chains. The street sweeper may also be provided with a manual mechanical adjustment mechanism to ensure that the chains remain tensioned.

The vertical chain driven conveyor apparatus may be provided with an automatically adjusting hydraulic or pneumatic adjustment system. The vertical chain driven conveyor apparatus may be provided with a ratchet pawl and pin adjustment mechanism to prevent the chains falling out of tension when the street sweeper is turned off. The conveyor apparatus may be provided with check valves to prevent the chains losing tension when the sweeper is turned off or may be provided with fully enclosed fluid system pressurized through an accumulator. Because fluids experience expansions and contractions due to temperature extremes, it may be desirable to compensate for these volumetric changes with a fully enclosed accumulator system.

On initial startup of the street sweeper, an initialization program begins. The initialization program energizes the conveyor system and immediately tensions the chains. The initialization programs may take several second to fully energize and initialize the system. The purpose of the initialization program is to ensure that any back off in chain tension that may have occurred during sweeper down time is removed to ensure that the chains do not slip off the sprockets upon initiating sweeping operations. The initialization program may also be adapted to prevent sweeping operations until a desired chain tension is achieved and indicated to the operator. The initialization program may take several second to achieve desired chain tension. However, any delay resulting in performing the initialization program is made up for in longer life of the equipment, quieter operation, and safer operation.

For purposes of this document a vertical conveyor may be considered as any conveyor which is more upright than horizontal, or at least 45 degrees from the horizontal. The problems which are solved by this invention become more extreme as the angle of the conveyor approaches 90 degrees with respect to the horizontal.

It is also important to note that the invention applies to other non-chain conveyors such as belt or band driven conveyors which are subject to wear and elongation. In the instance where a belt or band is used instead of a chain, a pulley wheel would replace chain sprockets on the ends of the shafts to direct the circuitous rotation of the conveyor apparatus. The word chain will be used throughout for the sake of convenience, but it is understood that the invention is not to be limited to merely chain driven conveyors, but to also encompass all manner of belt and band driven conveyors.

FIG. 1 illustrates a street sweeper having a vertical chain driven conveyor according to an embodiment of the present invention. In FIG. 1, a street sweeper 100 having a vertical chain driven conveyor apparatus 110 is disclosed. In operation, the street sweeper operator sits in the cab 150 from where he is able to drive the street sweeper 100 and also operate all the controls for the various debris removal operations.

The street sweeper 100 is provided with a forward debris directing brush 170, or vario-brush (optional) at the front of the street sweeper 100. The forward vario-brush 170 is hydraulically controllable to reach debris located along the extreme periphery of the sweeper 100 and direct the debris to a position where the sweeper 100 may pass over the debris. The forward vario-brush 170 includes a plurality of downwardly directed bristles that are controlled to interact with the street surface and vigorously scrub debris from the surface. The forward vario-brush 170 is adapted to move from side to side along the front of the street sweeper 100 permitting the operator to reach debris along the extreme periphery of the sweeper.

The loosened debris is then directed under the path of the sweeper 100 by the rotation of the vario-brush 170. The vario-brush 170, when located on the right side of the sweeper 100 is adapted to rotate in a counterclockwise direction and when vario-brush 170 is located on the left side of the sweeper is adapted to rotate in a clockwise direction to direct the debris into the path of the sweeper 100.

Behind the cab 150, a pair of central rotating brushes 160 are provided to direct debris into the vertical chain driven conveyor apparatus 110. The debris, now located under the center of the street sweeper is directed toward roller brush 120. Roller brush 120 includes a cylindrical shaft spanning the width of the street sweeper 100.

A plurality of bristles is provided on the cylindrical shaft of the roller brush 120. The roller brush 120 spins in a counterclockwise direction and lifts and directs debris up a ramp 112 and into an intermediate hopper 114 where the debris is elevated to the main hopper 130 (or to an intermediary hopper, not shown, and then to a the main hopper) by the vertical chain driven conveyor apparatus 110. Although the vertical chain driven conveyor 110 is shown being perpendicular to the street surface being cleaned, vertical, is defined herein to be any angle from about 45 degrees to 90 degrees from the horizontal or surface being swept.

The vertical chain driven conveyor apparatus 110 includes an upper shaft 122 and a lower shaft 132 connected by a pair of chains 116. The upper shaft 122 may be driven such as by a hydraulic motor 180 that rotates the upper shaft 122 though the lower shaft can alternatively be driven. The chains 116 rotate on sprockets 124 and the rotation of the upper shaft 122 through the chain linkage rotates the lower shaft 132. The lower shaft 132 is free to rotate and is not driven. The lower shaft 132 is fixed in position while the upper shaft 122 is adjustable on both ends to provide chain tensioning capability to the conveyor 110.

Periodically spaced upon the chains 116 are a plurality of scoops or flights 118. As the shafts 122,132 rotate, the chains 116 direct the flights 118 into the intermediate hopper 114 where debris is scooped up and elevated. When the flights 118 reach the top of the chain driven conveyor 110, the flights turn over and dump the collected debris into the main hopper 130 located at the rear of the street sweeper 100. Dust raised by the debris removal process is filtered by the air filtration system 140 so that only clean air is emitted from the rear of the street sweeper 100.

One disadvantage of any vertical chain driven conveyor apparatus is that in time, the chains, belts or bands tend to wear and elongate. The elongation of the chains 116 causes the chains to hang below the sprockets on the lower shaft 132 and interrupts and interferes with the debris removal process. The street sweeper operator is required to constantly check and manually adjust the chain, belt, or band tension to ensure proper operation. This is a time consuming and laborious process. Additionally, the chains, belts, and bands do not always wear at the same rate, causing the upper shaft 122 to be skewed from the horizontal when the chains have been manually adjusted to the desired tension.

Figure 2:
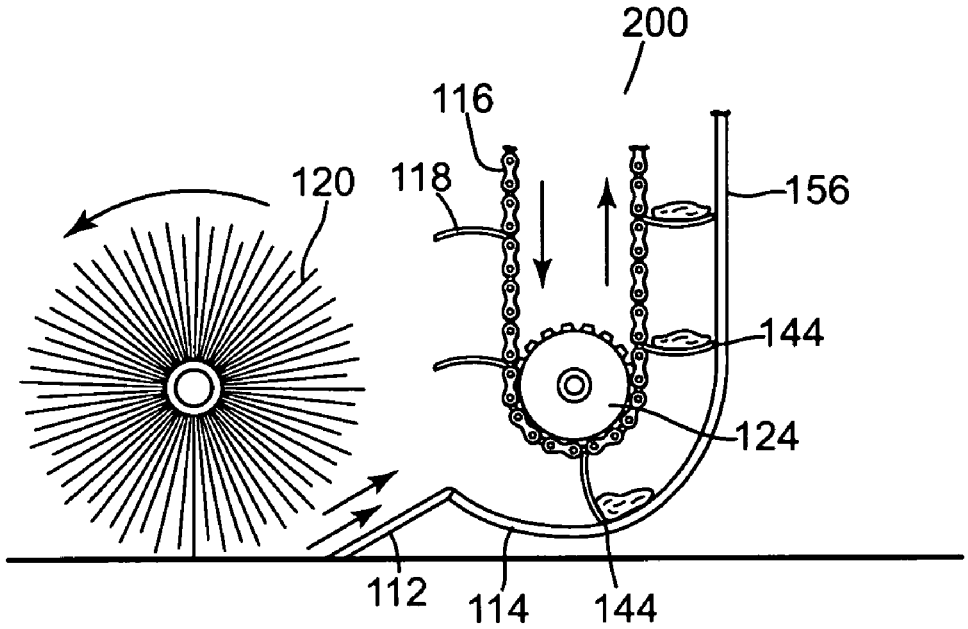
FIG. 2 illustrates the operation of the vertical chain driven conveyor apparatus with new chains according to an embodiment of the present invention.

FIG. 2 illustrates the proper operation of the vertical chain driven conveyor apparatus 200 according to an embodiment of the present invention. In FIG. 2, roller brush 120 rotates counterclockwise and the bristles cause debris to be swept up ramp 112 and into intermediate hopper 114. Properly adjusted, the chain 116 snugly interacts with sprocket 124 and the links of the chain 116 firmly engage the teeth of the sprocket 124.

The flights 118 enter the intermediate hopper 114, the lip 144 of the flight 118 just making contact with the bottom of the intermediate hopper 114 to facilitate removal of fine particulate debris, such as dust and sand. As the chain continues rotation and the flights are elevated, the lip 144 of the flights 118 may continue to engage the shield wall 156 to ensure that the debris does not rain back down into the intermediate hopper 114.

Figure 3:
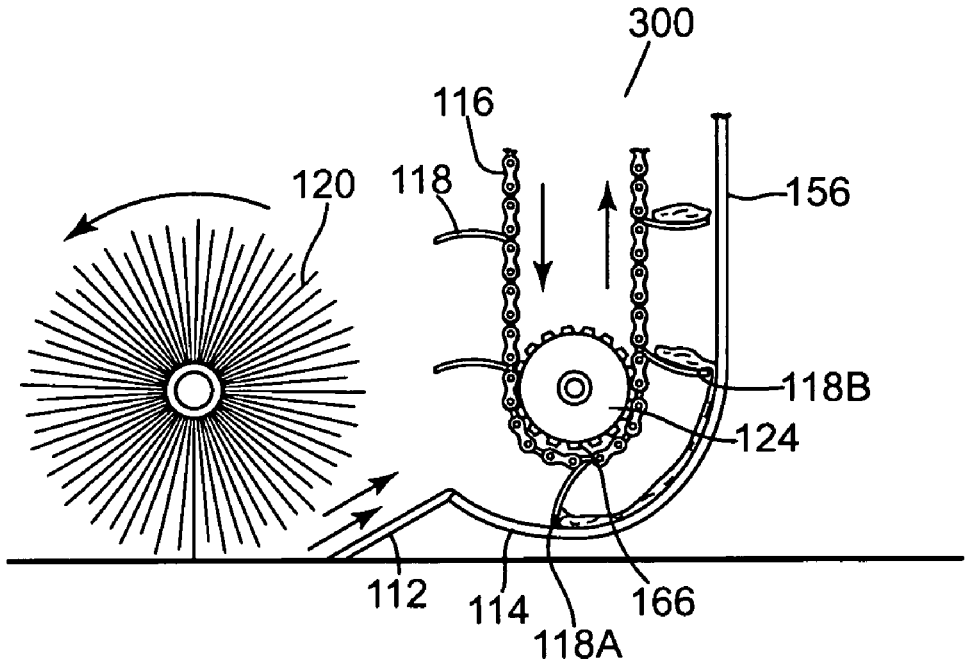
FIG. 3 illustrates a detrimental operation of the vertical chain driven conveyor apparatus with worn unadjusted chains according to an embodiment of the present invention.

FIG. 3 illustrates improper detrimental operation of the vertical chain driven conveyor 300 apparatus according to an embodiment of the present invention. In FIG. 3, the chain 116 is shown hanging below the bottom of the sprocket 124. The chain 116 is shown in a loosened state. It is noted that a belt or band may be used instead of a chain. A myriad of problems result from the chain 116 being improperly tensioned. For example, the flights 118 do not make proper contact with the bottom of the intermediate hopper 114.

A flight 118A is shown bent back at an awkward angle in the intermediate hopper 114. The flight 118A is unable to properly scoop debris. Another flight 118B demonstrates the failure of the conveyor to elevate debris. Debris is shown falling out of flight 118B and pouring back down into the intermediate hopper 114 because the flight is unable to make proper contact with shield wall 156 or maintain a horizontal orientation because of the slack in the chain 116.

Figure 4:
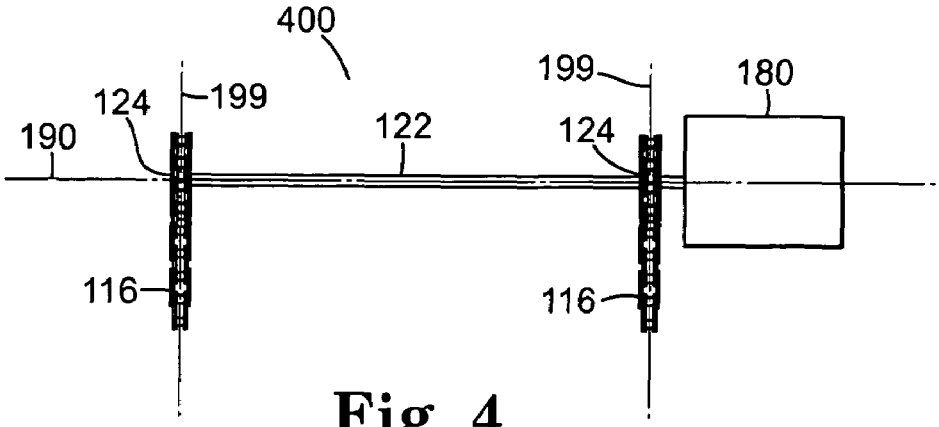
FIG. 4 illustrates adjustment of new chains in the vertical chain driven conveyor apparatus according to an embodiment of the present invention.

FIG. 4 illustrates proper adjustment 400 of new chains in the vertical chain driven conveyor apparatus according to an embodiment of the present invention. When new chains 116 are provided in the vertical chain driven conveyor apparatus the orientation of the upper driving shaft 122 is along the horizontal axis 190. The sprockets 124 and the chains 116 are oriented along perpendicular axis 199 to the upper driving shaft 122 and the horizontal axis 190. The upper driving shaft 122 is driven by hydraulic motor 180.

Figure 5:
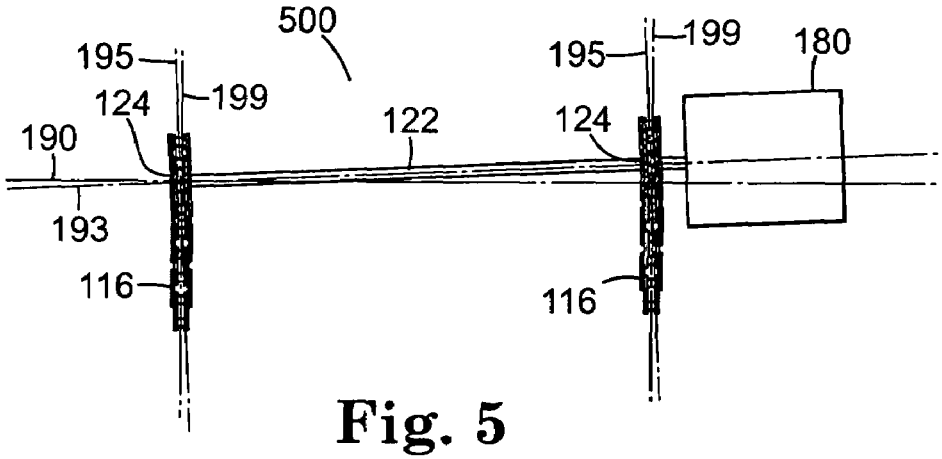
FIG. 5 illustrates skewing that occurs with worn chains in tensioned adjustment in the vertical chain driven conveyor apparatus according to an embodiment of the present invention.

FIG. 5 illustrates skewing that occurs with worn chains in tensioned adjustment 500 of the vertical chain driven conveyor apparatus according to an embodiment of the present invention. After several hundred hours of street sweeping activity, the chains 116 elongate and wear. The constant tension and abrasion from sand, dust and other particulate matter cause the chains 116 to elongate several centimeters.

The chains 116 do not wear at the same rate causing one chain 116 to be a few centimeters longer than the other chain. The street sweeper operator must maintain the chains 116 in a tensioned position to overcome the disadvantage disclosed in FIG. 3. The vertical chain driven conveyor apparatus is provided with tensioning adjustment mechanisms (discussed below) to adjust the tension in each of the chains, belts, or bands.

When the worn chains are properly tensioned, the shaft 122 is no longer oriented along the horizontal axis 190, but rather along axis 193 at some angle with respect to the horizontal axis 190. This skewing of the shaft's axis 193 causes the sprockets 124 and that portion of the chains disposed upon the sprockets to no longer be perpendicular to the horizontal axis 190, but rather disposed along axis 195 at some angle with respect to the perpendicular axis 199 of the chains 116. The skewing of upper driving shaft 122 intensifies the stress on the vertical chain driven conveyor apparatus and presents the risk that the chain will jump off of the sprocket resulting in catastrophic damage to the street sweeper.

Figure 6:
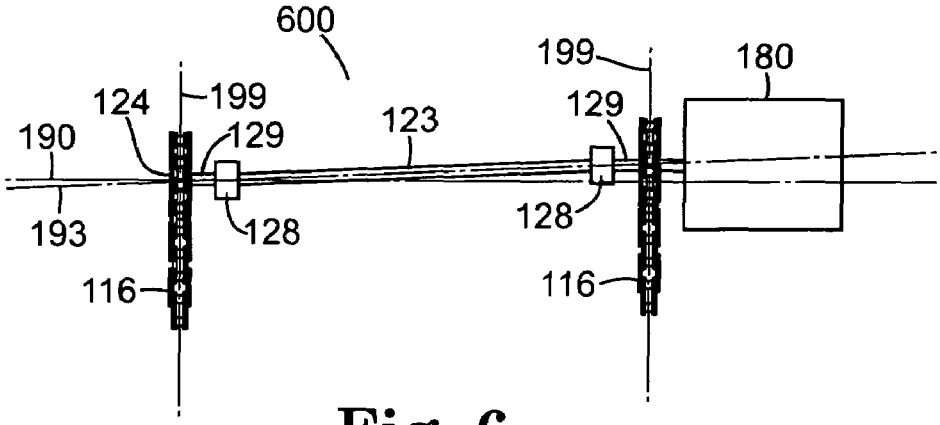
FIG. 6 illustrates a multiple jointed shaft compensation system to prevent worn chain skewing of the vertical chain driven conveyor apparatus according to an embodiment of the present invention.

FIG. 6 illustrates a multi-directionally jointed shaft compensation system 600 to prevent worn chain skewing of the upper driving shaft of the vertical chain driven conveyor apparatus according to an embodiment of the present invention. In FIG. 6, a multi-directionally jointed shaft 123 has been provided to compensate for the skewing effect presented by the wear of the chains 116.

The sprockets 124 and chains 116 are maintained along axis 199 perpendicular to the horizontal axis 190 while the central extent of the shaft 123 is permitted to be disposed along axis 193 at some angle with respect to the horizontal axis 190. The shaft 123 includes universal type multidirectional joints 128 that are able to be rotated in multiple directions while maintaining a different axis on either side of the joint 128. (Notice that the lower shaft could likewise or alternatively be provided with joints. Indeed, while the preferred embodiment focuses on the upper shaft features of tensioning and adjustment, it would also be done on the lower shaft. The first axis may be the axis of the sprocket shaft 129 and the second axis may be the shaft axis 193.

The jointed shaft compensation system 600 maintains the chains 116 in proper tension for removal of debris, compensates for varying chain lengths during the life of the chains, and maintains the orientation of the chains along perpendicular axis 199 to prevent catastrophic damage to the street sweeper during operation.

Figure 7:
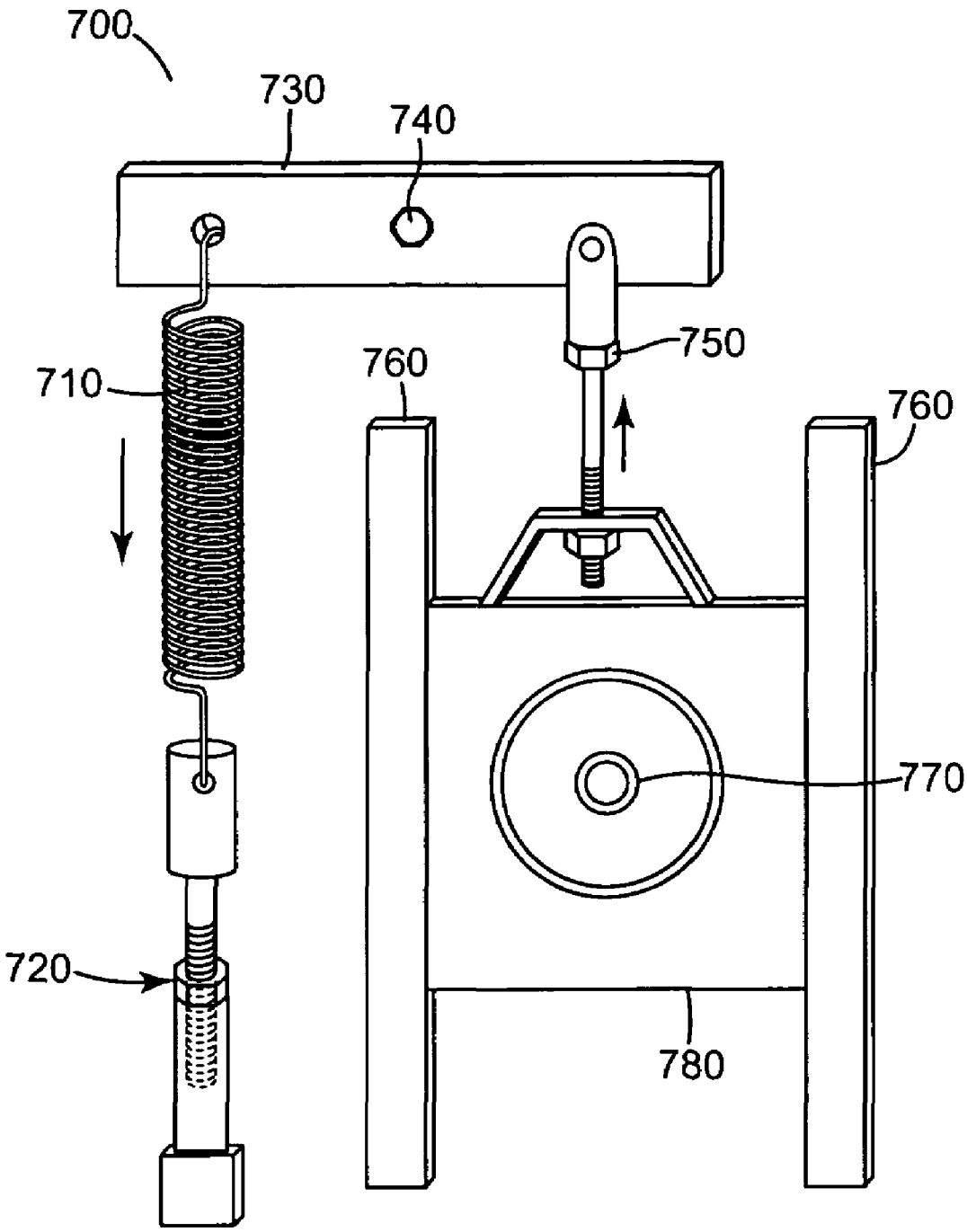
FIG. 7 illustrates a manual mechanical adjustment for tensioning the chains in the vertical chain driven conveyor apparatus according to an embodiment of the present invention.

FIG. 7 illustrates a manual adjustment mechanism 700 for tensioning the chains in the vertical chain driven conveyor apparatus according to an embodiment of the present invention. In operation, an independent manual mechanical adjustment mechanism will be provided at each end of the upper driving shaft to cause both chains, belts, or bands to have the desired tension therein. However, only one side will be fully described and shown, however, it is understood that the other side will operate in an identical fashion.

In FIG. 7, a spring 710 with a high spring constant is attached to a fulcrum 730. The spring 710 absorbs shock and prevents oscillation of the upper drive shaft when in operation. The fulcrum 730 pivots at pivot point 740. At the other end of the fulcrum 730, a support linkage 750 is provided. The support linkage 750 is connected to a base member 780 which support one side of the upper shaft 770. The base member 780 is able to slide up and down within adjustment frames 760.

To maintain tension in the chain, mechanical adjustment 720 is adjusted to apply tension to the spring 710. The spring 710 pulls down on one end of the fulcrum 730 causing the fulcrum 730 to pivot at pivot point 740 and pulling up on support linkage 750. The upward force of the support linkage 750 pulls the base member 780 upward and in conjunction therewith, the upper driving shaft 770 is pulled upward maintaining the chain in desired tension. Visual inspection of the chains, belts or bands is required frequently by the street sweeper operator. When it is noticed that the chains have become loose, the operator manually adjusts the mechanical adjustment 720, the support linkage 750, or both, as necessary.

Figure 8:
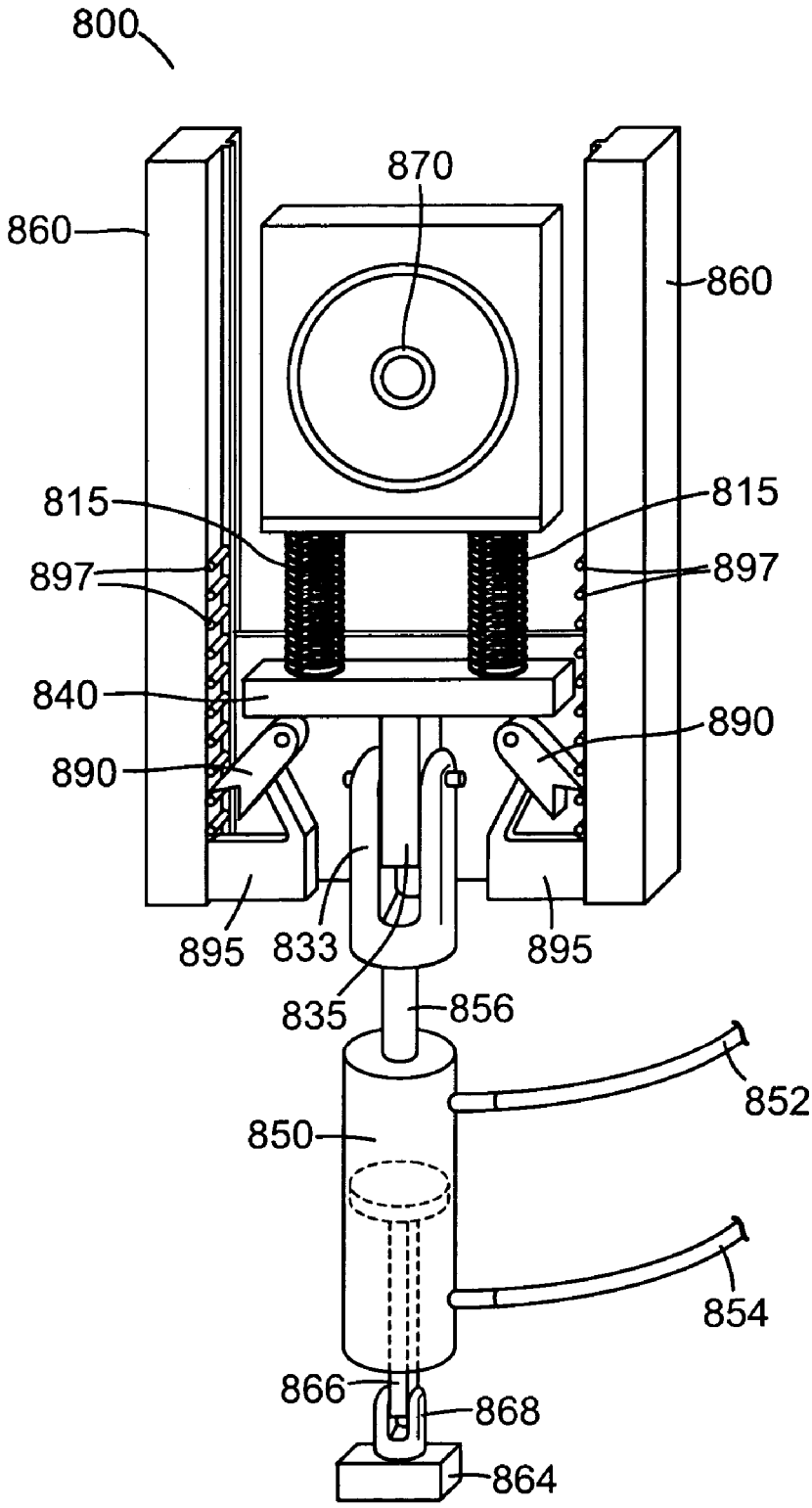
FIG. 8 illustrates an automatically adjusting hydraulic or pneumatic tensioning adjustment for tensioning the chains in the vertical chain driven conveyor apparatus according to an embodiment of the present invention.

FIG. 8 illustrates an automatically adjusting hydraulic tensioning adjustment 800 for tensioning the chains in the vertical chain driven conveyor apparatus according to an embodiment of the present invention. In operation, an independent automatic hydraulic or pneumatic adjustment mechanism will be provided at each end of the upper driving shaft to cause both chains to have the desired tension therein. However, only one side will be fully described and it is understood that the other side will operate in an identical fashion.

In FIG. 8, instead of independent manual mechanical adjustment, an independent hydraulic or pneumatic cylinder 850 may be provided for maintaining tension in the chains on each end of the upper driving shaft. In fact, any length adjustable shaft system could suffice so long as it can alter the distance between upper and lower shafts and preferably be remotely driven or controlled. Electric, mechanical, hydraulic, pneumatic and all other known means or systems of the future which can achieve that requirement should be considered equivalent. The cylinder 850 is provided with an input connection 854 and an output connection 852. It is understood that a fluid/gas may enter or exit from either connection 854, 852. The cylinder 850 has a mounting tongue 866 connected to a mounting yoke 868 which is connected to a mounting frame member 864. At the other end, the cylinder 850 is provided with an extendible shaft 856.

The extendible shaft 856 is provided with a support yoke 833 which is connected to a support tongue 835 connected to base member 840. The base member 840 is able to freely slide up and down within adjustment frames 860. The upper driving shaft 870 is supported on a pair of springs 815 which absorb shock and prevent oscillation of the upper drive shaft 870 during street sweeping activities. Springs 815 form a flexible link and could alternatively be located on the lower shaft.

In operation, the extendible shaft 856 of cylinder 850 pushes upwardly on base member 840 which in turn pushes up on upper driving shaft 870 through springs 815. The cylinder 850 maintains a constant desired pressure, preferably regulated pressure, upwardly on the upper drive shaft 870 and automatically extends farther as the chain becomes worn ensuring constant tension in the chain. The piston and rod are shown in dotted lines in the cylinder. In the preferred embodiment, pressure is regulated on the bore side of the piston rather than the rod side, though both are possible.

The cylinder 850 may be provided with an accumulator set to maintain a specific hydraulic pressure, for example, 250 psi (pounds per square inch). The accumulator is operative with a fully enclosed fluid/gas system to ensure constant pressure throughout the system and to compensate for variations due to changes in temperature. The cylinder may also be provided with compressed gas capable of applying a constant pneumatic pressure of, for example, 250 psi.

In order to maintain the chain in tension when the street sweeper is turned off, the adjustment frames 860 have been provided with a plurality of adjustment pins 897 along the height thereof, a pair of ratchet pawl adjustments 890 to interact with the pins, and the ratchet pawl adjustments 890 are themselves tensioned by tensioning means 895. The ratchet adjustment may also be provided with an eccentric spring-loaded cam to compensate for variations between adjustment pins in the ratchet pawl and pin adjustment system.

Figure 9:
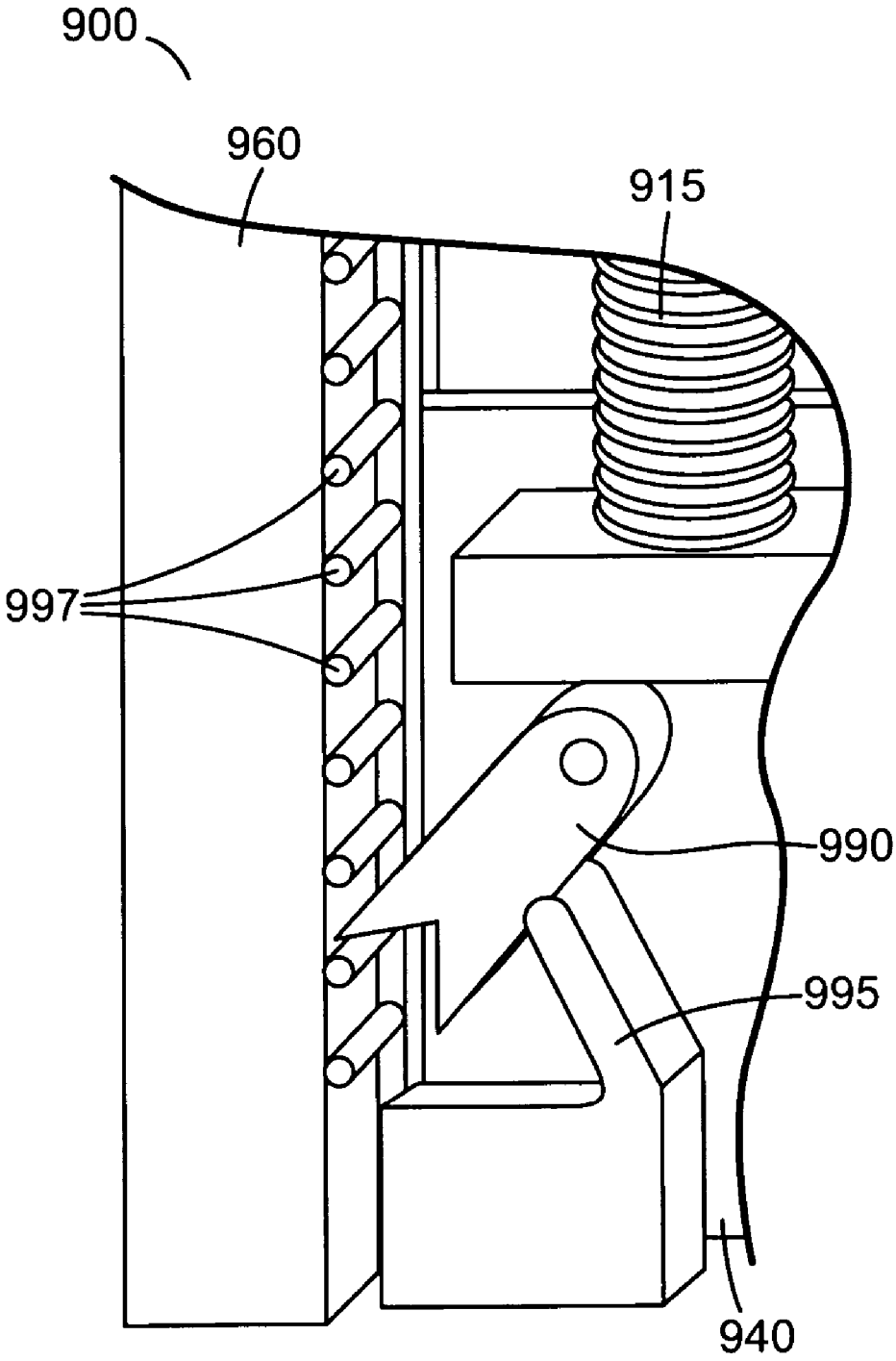
FIG. 9 illustrates an enlarged view of the ratchet pawl and pin locking mechanism for maintaining chain tension when the street sweeper is turned off in the vertical chain driven conveyor apparatus according to an embodiment of the present invention.

FIG. 9 illustrates an enlarged view of the ratchet pawl and pin locking mechanism 900 for maintaining chain tension when the street sweeper is turned off in the vertical chain driven conveyor apparatus according to an embodiment of the present invention. When the street sweeper is turned off the cylinder may leak off fluid allowing the extendible shaft to reenter the cylinder.

To prevent the extendible shaft from reentering the cylinder and slack developing in the chains, the vertical chain driven conveyor apparatus may be provided with a plurality of adjustment pins 997 associated with adjustment frames 960. The base member 940 may also be provided with a ratchet pawl adjustment 990 tensioned to engage the adjustment pins 997. As the extendible shaft pushes the base member 940 up, the ratchet pawl adjustment 990 is pushed up past adjustment pin 997. The tensioning means 995 pushes the ratchet pawl adjustment 990 against the adjustment frame 960, locking the shaft in the desired position.

When the extendible shaft no longer pushes the base member 940 upwardly, the engagement between the ratchet pawl adjustment 990 and the adjustment pin 997 prevents the base member 940 from falling down under the force of gravity, thus maintaining tension in the chain. The tensioning means 995 may be a rubber or metal leaf spring as shown in FIG. 9, or may be some other device which provides tension to the ratchet pawl adjustment 990 against the adjustment frame 960, such as a coil spring.

Figure 10:
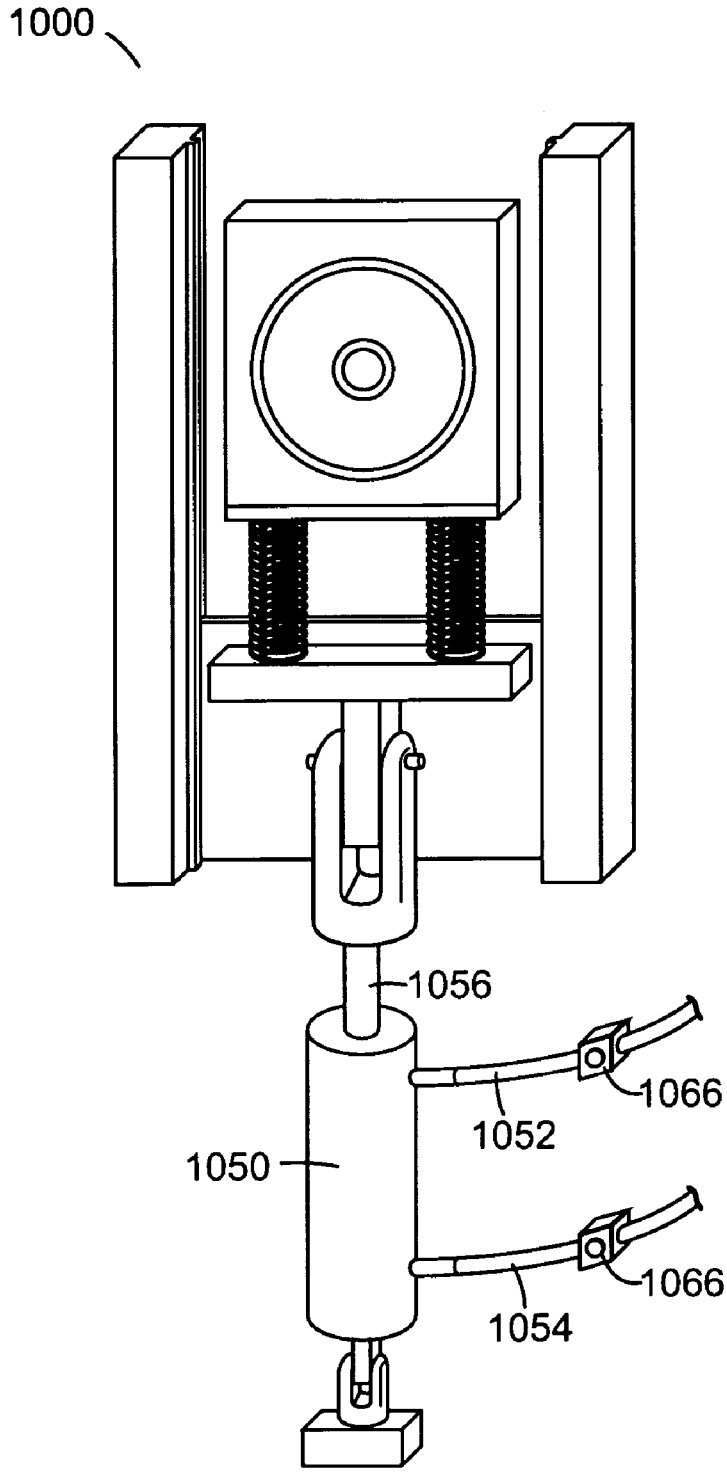
FIG. 10 illustrates providing check valves for locking an automatically adjusting tensioning adjustment mechanism for maintaining chain tension when the street sweeper is turned off in the vertical chain driven conveyor apparatus according to an embodiment of the present invention.

FIG. 10 illustrates providing check valves for locking an automatically adjusting tensioning adjustment locking mechanism 1000 for maintaining chain tension when the street sweeper is turned off in the vertical chain driven conveyor apparatus according to an embodiment of the present invention. In FIG. 10, instead of using the ratchet pawl and pin adjustment locking mechanism shown in FIG. 9, the input and output connection lines 1052 and 1054, respectively, are provided with check valves 1066. The check valves 1066 prevent the extendible shaft 1056 from reentering the cylinder when the street sweeper is turned off, by preventing the movement of fluid/gas into or out of the cylinder 1050.

Alternatively, the fluid/gas system may be a fully enclosed pressurized tank system provided with an accumulator to ensure that when the sweeper is turned off, the fluid remains static throughout the system, thus preventing the chains losing tension.

The safe operation of the street sweeper is also ensured by a method of initializing street sweeping operations. An initialization program is activated to restore tension in a plurality of chains associated with a vertical conveyor apparatus in a street sweeper after sweeper down time. The initialization program energizes the automatic chain tensioning apparatus, applies a tensioning force to ends of a drive shaft associated with the chains, and indicates when a desired chain tension has been achieved. The program also prevents sweeping operations from occurring until the desired chain tension has been indicated. The initialization program automatically initiates when the street sweeper is turned on and delays sweeping operations for several seconds while chain tension is analyzed and determined. This delay could be eliminated or reduced by real time feedback and adjustment. Of course follow-up measurements would be desirable to monitor chain tension.

It is understood that alternate structures for the street sweeper having the vertical chain driven conveyor apparatus with an automatically adjustable and locking tensioning mechanism may be provided without departing from the scope of the invention.

For purposes of this document a vertical conveyor may be considered as any conveyor which is more upright than horizontal, or more than 30 degrees (typically 45+) from the horizontal. The problems which are solved by this invention become more extreme as the angle of the conveyor approaches 90 degrees with respect to the horizontal.

It is also important to note that the invention applies to other non-chain conveyors such as belt or band driven conveyors which are subject to wear and elongation. The word chain will be used throughout for the sake of convenience, but it is understood that the invention is not to be limited to merely chain driven conveyors.

The foregoing objects, advantages and distinctions of the invention, among others, are obtained in a presently preferred construction that provides a street sweeper having a vertical chain driven conveyor apparatus. The vertical chain driven conveyor apparatus may be provided with a multiple jointed shaft to compensate for chain stretch and wear over the life of the chains. The street sweeper may be provided with a manual mechanical adjustment mechanism to ensure that the chains remain tensioned.

The vertical chain driven conveyor apparatus may be provided with an automatically adjusting hydraulic or pneumatic adjustment system. The vertical chain driven conveyor apparatus may be provided with a ratchet pawl and pin adjustment locking mechanism to prevent the chains from falling out of tension when the street sweeper is turned off. The conveyor apparatus may be provided with check valves to prevent the chains losing tension when the sweeper is turned off or an accumulator associated with a fully enclosed pressurized system. The apparatus may also be provided with an initialization program to restore chain tension in the first several seconds after the sweeper is turned on, energizing and tensioning the system to prevent the chains slipping off the sprockets of the shafts.

The foregoing description of an exemplary embodiment of the invention has been presented for the purpose of illustration and description. It is not intended to be exhaustive or to limit the invention to the precise form disclosed. Many modifications and variations are possible in light of the above teaching. It is intended that the scope of the invention be limited not with this detained description, but rather by the claims appended hereto.

What is claimed is:

1. A chain conveyor comprising:

a first driving shaft, the first shaft comprising a at least one multi-directional rotatable joint and ends of the shaft rotate about a horizontal axis while a central extent of the shaft between the joints rotates about an axis oriented at an angle with respect to the horizontal axis;

a second shaft;

at least a pair of chains operatively connecting the first and second shafts and a pressure responsive cylinder having an extendible shaft for providing and maintaining tension in the chains and further comprising a locking adjustment mechanism for maintaining tension in the chains when the conveyor Is not energized.

2. The conveyor according to claim 1, further comprising independent automatically adjusting chain tensioning mechanisms for maintaining tension in each of the chains.

3. The conveyor according to claim 2, wherein the chain adjusting mechanisms comprise a length adjustable cylinder having an extendible shaft for providing and maintaining tension in the chains.

4. The conveyor according to claim 2, wherein the chain adjusting mechanisms comprise a pressure responsive cylinder being resiliently attached to at least one of said shafts, and having an extendible shaft for providing and maintaining tension in the chains.

5. A vertical conveyor apparatus comprising:

an upper driving shaft;

a lower shaft;

at least a pair of chains operatively connecting the shafts;

independent automatically adjusting chain tensioning mechanisms for maintaining tension in each of the chains including a pressure responsive cylinder having an extendible shaft for providing and maintaining tension in the chains; and a plurality of flights, each flight associated with each of the chains and wherein the upper driving shaft includes at least one rotatable multi-directional joint and portions of the shaft are oriented along different axes of rotation.

6. The conveyor apparatus according to claim 5, wherein the chain adjusting mechanisms comprise a hydraulic cylinder having an extendible shaft for providing and maintaining tension in the chains.

7. The conveyor apparatus according to claim 5, wherein the chain adjusting mechanisms comprise a pneumatic cylinder having an extendible shaft for providing and maintaining tension in the chains.

8. The conveyor apparatus of claim 5, wherein the at least one rotatable multi-directional joint further comprises two rotatable multi-directional joints and ends of the shaft are oriented along a horizontal axis and a central extent of the shaft between the joints is oriented at an angle with respect to the horizontal axis.

9. The conveyor apparatus of claim 5, further comprising a locking adjustment mechanism for maintaining tension in the chains.

10. A vertical conveyor apparatus comprising:

an upper driving wheel;

a lower driven wheel;

at least a pair of drive bands operatively connecting the wheels;

independent automatically adjusting band tensioning mechanisms for maintaining tension in each of the bands including a pressure responsive cylinder having an extendible shaft for providing and maintaining tension in the chains; and a plurality of flights, each flight associated with each of the bands wherein the upper driving wheel is operatively connected to a shaft including at least one rotatable multi-directional joint and portions of the shaft are orientable along different axes of rotation when band tension is adjusted.

11. The conveyor apparatus according to claim 10, wherein the band adjusting mechanisms comprise a hydraulic cylinder having an extendible shaft for providing and maintaining tension in the bands.

12. The conveyor apparatus according to claim 10, wherein the band adjusting mechanisms comprise a pneumatic cylinder having an extendible shaft for providing and maintaining tension in the bands.

13. The conveyor apparatus of claim 10, wherein the at least one rotatable multi-directional joint further comprises two rotatable multi-directional joints and ends of the shaft are oriented along a horizontal axis and a central extent of the shaft between the joints is orientable at an angle with respect to the horizontal axis when band tension is adjusted.

14. The conveyor apparatus of claim 10, further comprising a locking adjustment mechanism for maintaining tension in the bands.

15. The conveyor apparatus according to claim 10, wherein the band adjusting mechanisms comprise a remotely adjustable mechanism for providing and maintaining tension in the bands.

16. The conveyor apparatus according to claim 10, wherein the band adjusting mechanisms comprise a manual mechanical adjustment mechanism for providing and maintaining tension in the bands.

17. The conveyor apparatus according to claim 10 wherein the lower driven wheel is operatively connected to a shaft orientable along a horizontal axis of rotation when band tension is adjusted.

* * * * *